US007426892B2

(12) United States Patent
Jurng et al.

(10) Patent No.: US 7,426,892 B2
(45) Date of Patent: Sep. 23, 2008

(54) WATER-COOLED GRATE

(75) Inventors: Jong Soo Jurng, Seoul (KR); Sung Min Chin, Uijeongbu-si (KR); Seung Woo Lee, Incheon (KR)

(73) Assignee: Korea Institute of Science and Technology, Seoul (KR)

( * ) Notice: Subject to any disclaimer, the term of this patent is extended or adjusted under 35 U.S.C. 154(b) by 441 days.

(21) Appl. No.: 11/322,807

(22) Filed: Dec. 30, 2005

(65) Prior Publication Data

US 2007/0006785 A1 Jan. 11, 2007

(30) Foreign Application Priority Data

Jul. 11, 2005 (KR) ..... 10-2005-0062340

(51) Int. Cl.
*F23H 3/00* (2006.01)

(52) U.S. Cl. ..... 110/298; 110/327; 432/77

(58) Field of Classification Search ..... 110/298, 110/299, 300, 327, 281; 432/77, 78; 126/163 R
See application file for complete search history.

(56) References Cited

U.S. PATENT DOCUMENTS 4,096,809 A * 6/1978 Martin et al. ..... 110/271
4,235,172 A * 11/1980 Martin et al. ..... 110/281

FOREIGN PATENT DOCUMENTS

| | | | |
|---|---|---|---|
| JP | 10-246417 | A | 9/1998 |
| JP | 12-240926 | A | 9/2000 |
| JP | 14-48327 | A | 2/2002 |
| KR | 2002-35506 | A | 5/2002 |

* cited by examiner

*Primary Examiner*—Kenneth B Rinehart
(74) *Attorney, Agent, or Firm*—Jones Day

(57) ABSTRACT

The present invention relates to a water-cooled grate, which can be cooled while avoiding high and low temperature corrosions. The water-cooled grate comprises: at least one cooling pipe for guiding flow of cooling water; a grate body for placing waste matters to be burned, said grate body being formed with a pipe-receiving portion for receiving the cooling pipe; and a heat transfer controlling member fixed to the pipe-receiving portion for increasing and decreasing heat transfer between the grate body and the cooling pipe by varying thermal resistance to the cooling pipe through thermal deformation according to temperature change of the grate body.

8 Claims, 8 Drawing Sheets

WATER-COOLED GRATE

FIELD OF THE INVENTION

The present invention generally relates to a water-cooled grate, and more particularly to a water-cooled grate for use in an incinerator, which may be cooled while avoiding high and low temperature corrosions.

BACKGROUND OF THE INVENTION

Typically, conventional incinerators for burning residential and industrial waste matters are classified into three types: a stoker type, a fluidized bed type and a rotary kiln type. Among them, the stoker type incinerator is generally utilized. The stoker type incinerator has grates arranged in multi-steps in an incinerator, wherein waste matters to be burned are incinerated while being moved along the grates.

There is a need to cool down the grate in order to increase the life span of the grate, which places and burns waste matters thereon, and to reduce the amount of pollutants that result from imperfect combustion. To cool a grate, an air-cooling type or a water-cooling type is generally employed. The air-cooling type resorts to a cooling method wherein the grate is cooled and waste matters are burned by feeding air for combustion from underneath the grate. The water-cooling type utilizes a cooling method wherein cooling pipes are equipped in/on the grate and the grate is cooled by means of cooling water flowing through the cooling pipes so as to prevent high temperature corrosion, which is a serious drawback of the air-cooling type.

Japanese Patent Laid-Open Publication No. 2000-240926 discloses a water-cooled grate, wherein U-shaped pipes are provided at the front face of the grate. Also, Korean Patent Laid-Open Publication No. 2002-0091022 discloses a fixed type water-cooled combustion grate, wherein cooling water circulates along blocking plates placed inside the grate to cool off the grate.

However, in case of the above water-cooled grates, when the amount of waste matter is decreased in a partial-load operation of an incinerator or a thermal load of the incinerator becomes reduced just before shutting down the incinerator, the cooling water overcools the grate. Thus, the surface temperature of the grate drops below a prescribed point. Among various combustion gases, substances containing corrosive components then condense on the surface of the grate. As such, low temperature corrosion occurs on the surface of the grate. Such low temperature corrosion typically leads to increased costs associated with grate maintenance and pollutant control.

Further, in order to prevent overcooling of the grate by means of cooling water, a procedure of controlling the flow rate or the temperature of cooling water may be applied. However, such procedure is difficult to implement since the surface of the grate cannot be properly controlled. Accordingly, there is a need to cool off a grate, which is used in an incinerator, in a simple and effective manner while enhancing the cooling performance thereof.

SUMMARY OF THE INVENTION

Therefore, it is an object of the present invention to provide a water-cooled grate, wherein its cooling performance is enhanced in a simple and effective manner.

It is another object of the present invention to provide a water-cooled grate, which can be cooled while avoiding high and low temperature corrosions.

Consistent with the above and in accordance with the invention as embodied broadly herein, there is provided a water-cooled grate for use in an incinerator, comprising: at least one cooling pipe for guiding flow of cooling water; a grate body on which matters to be burned are placed, said grate body being formed with a pipe-receiving portion for receiving the cooling pipe; and a heat transfer controlling member fixed to the pipe-receiving portion for increasing and decreasing heat transfer between the grate body and the cooling pipe by varying thermal resistance to the cooling pipe through thermal deformation according to temperature change of the grate body.

In the water-cooled grate having the above constitution, the heat transfer between the grate body and the cooling pipe occurs via the heat transfer controlling member fixed to the grate body. Since the heat transfer controlling member is in contact with the cooling pipe while performing thermal deformation such as expansion or contraction according to thermal states of the grate body, the heat transfer controlling member presses down upon the cooling pipe at various different extents. The thermal contact resistance between the heat transfer controlling member and the cooling pipe is decreased when the grate body is at a high temperature. However, it is increased when the grate body is at a low temperature. Since the heat transfer between the grate body and the cooling pipe is increased at a high temperature and is decreased at a low temperature, the heat transfer controlling member can increase and decrease the heat transfer between the grate body and the cooling pipe. Accordingly, cooling performance is improved since more heat transfer occurs in case of the high temperature state wherein the thermal load of the grate body is high. Also, the overcooling of the grate body by cooling water may be avoided because there is less heat transfer in the low temperature state wherein the thermal load of the grate body is low.

In the present invention, it is preferable that the heat transfer controlling member is configured so that it can wrap the cooling pipe received in the pipe-receiving portion.

In such a case, since the cooling pipe is received in the pipe-receiving portion and the heat transfer controlling member is configured so as to wrap the cooling pipe positioned in the pipe-receiving portion, the heat transfer controlling member and the cooling pipe can be placed in contact with each other throughout an entire area of the pipe-receiving portion.

It is further preferable that the pipe-receiving portion is a groove formed at a surface of the grate body or a bore passing through the grate body.

In such a case, in order to arrange the cooling pipe for cooling the grate body, there is provided a groove formed at the lower surface of the grate body or a bore passing through the grate body. The cooling pipe is positioned in the groove or the bore. The heat transfer controlling member, which is fixed to a wall of the groove or the bore, performs thermal deformation of expansion or contraction according to the thermal states of the grate body. The heat transfer controlling member, which is arranged in the groove or the bore, is closely fixed to a wall of the groove or the bore and is configured so as to wrap the cooling pipe received in the area defined by the groove or the bore.

Further, it is preferable that the heat transfer controlling member and the cooling pipe are positioned with respect to each other so that a constant gap may be formed therebetween at a normal temperature.

In such a case, since the gap exists between the heat transfer controlling member and the cooling pipe, the heat transfer controlling member and the cooling pipe are placed in contact with each other or are separated from each other. This is so that the heat transfer can be interrupted or initiated automatically and mechanically.

It is further preferable that the gap is formed so that the heat transfer controlling member expands and contacts the cooling pipe when the temperature of the grate body remains above a certain temperature range.

In such a case, the gap is determined so that the heat transfer controlling member expands and contacts the cooling pipe when the temperature of the grate body is above a certain temperature range. Therefore, as the temperature of the grate body rises, the heat transfer occurs only when the heat transfer controlling member is placed in contact with the cooling pipe above the prescribed temperature range. Also, as the temperature of the grate body drops, the heat transfer can be interrupted because the heat transfer controlling member and the cooling pipe are separated from each other below the prescribed temperature range. Accordingly, the overcooling of the grate body can be avoided below the prescribed temperature range.

Further, it is preferable that the heat transfer controlling member is made from metal, which has a larger thermal expansion coefficient than that of the grate body.

In such a case, the heat transfer controlling member made from metal thermally deforming according to the thermal states of the grate body. Thus, when the grate body is at a high temperature, the heat transfer controlling member expands to a relatively large extent and presses down the cooling pipe to decrease the thermal contact resistance. Further, when the grate body is at a low temperature, the heat transfer controlling member expands to a relatively small extent and does not press down the cooling pipe as much in order to increase the thermal contact resistance. Moreover, the thermal expansion coefficient of the heat transfer controlling member is larger than that of the grate body. Hence, if the heat transfer controlling member is disposed between the grate body and the cooling pipe and then thermally expands by means of heat of the grate body, the heat transfer controlling member presses down both the grate body and the cooling pipe so as to further increase the heat transfer therebetween.

Further, it is preferable that a large number of cooling pipe is provided. It is also preferable that the water-cooled grate further comprises first and second pipes connecting the cooling pipes, wherein the first pipe guides the inflow of cooling water and a second pipe guides the outflow of cooling water passing through the cooling pipes.

In such a case, when comparing to a case where a single cooling pipe is arranged throughout a grate, since the cooling water supplied into the water-cooled grate is simultaneously supplied into a plurality of cooling pipes and discharged therefrom, the cooling efficiency can be improved.

BRIEF DESCRIPTION OF DRAWINGS

The above object and features of the present invention will become more apparent from the following description of the preferred embodiments given in conjunction with the accompanying drawings.

DETAILED DESCRIPTION OF THE PRESENT INVENTION

The preferred embodiments of the present invention will now be described with reference to the accompanying drawings by way of example wherein the water-cooled grate, which is constructed in accordance with the present invention, is employed in a stoker-type incinerator. Herein, the terms "high temperature" and "low temperature" of the water-cooled grate or the grate body are intended to mean a state wherein a thermal load of the grate or the body is high and a state wherein a thermal load of the grate or the body is low, respectively.

Figure 1:
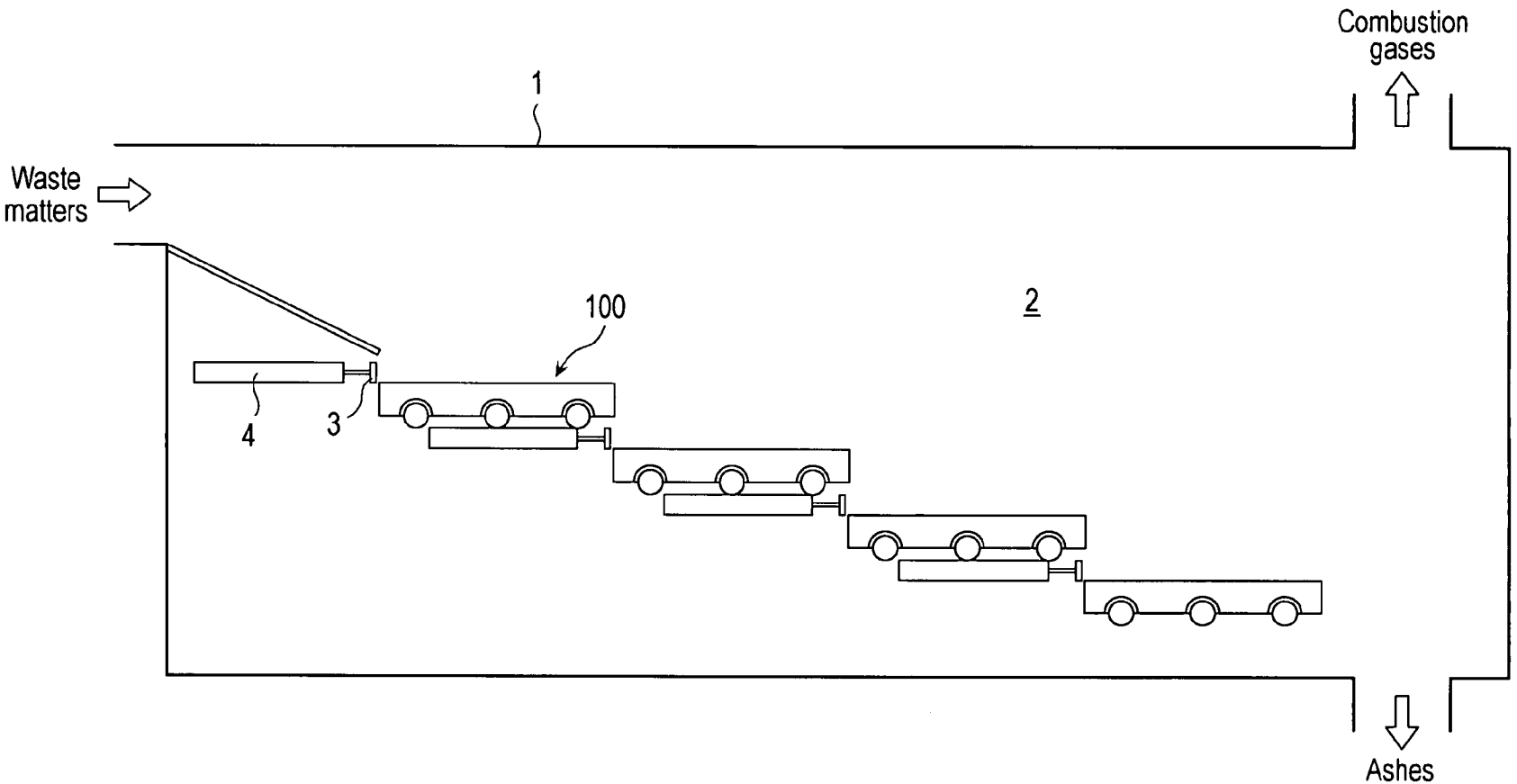
FIG. 1 is a schematic view illustrating an incinerator wherein a water-cooled grate, which is constructed in accordance with a preferred embodiment of the present invention, is employed.

FIG. 1 illustrates a schematic configuration of an incinerator wherein the water-cooled grate constructed in accordance with a preferred embodiment of the present invention is employed. The incinerator 1, which is illustrated in FIG. 1, is an example of a stoker-type incinerator for burning residential or industrial waste matters. Certain detailed components of the incinerator are omitted for ease of description.

As illustrated in FIG. 1, if the waste matter is conveyed or thrown into the incinerator 1, the waste matter is burned in the incinerator 1 while passing through the water-cooled grates 100, which is arranged in multi-steps by a constant elevation. Then, the completely burned waste matter is dumped out through an ash outlet, which is provided at a lower side of the incinerator 1. Transportation between each water-cooled grate is accomplished by means of a pusher 3 driven by a hydraulic device 4.

The water-cooled grate serves to transport the waste matter and facilitate incineration in the incinerator 1. Therefore, the water-cooled grate should resist high temperature and corrosion caused by combustion gases generated during incineration, as well as abrasion that occurs during the transportation of waste matter. Thus, the water-cooled grate should be made from metal having high strength and superior corrosion-resistance. The water-cooled grate has an essential utility in a stoker-type incinerator. In order to raise the combustion temperature in the incinerator and protect the water-cooled grate therein, the water-cooled grate must be adequately cooled.

Particularly, the water-cooled grate may be corroded by corrosive gases such as HCL, $SO_x$ among combustion gases generated during incineration. Such corrosion can be classified into high temperature corrosion occurring at greater than about 350° C. and low temperature corrosion occurring at less than about 150° C. Also, it is known that the velocity of corrosion occurring at any surface of metal is slowest in the range of 150° C. to 330° C. Accordingly, there is a need for cooling the grate while avoiding high and low temperature corrosions in order to protect the grate. According to the present invention, there is provided the water-cooled grate, which is cooled by means of cooling water flowing inside the cooling pipe.

Figure 2:
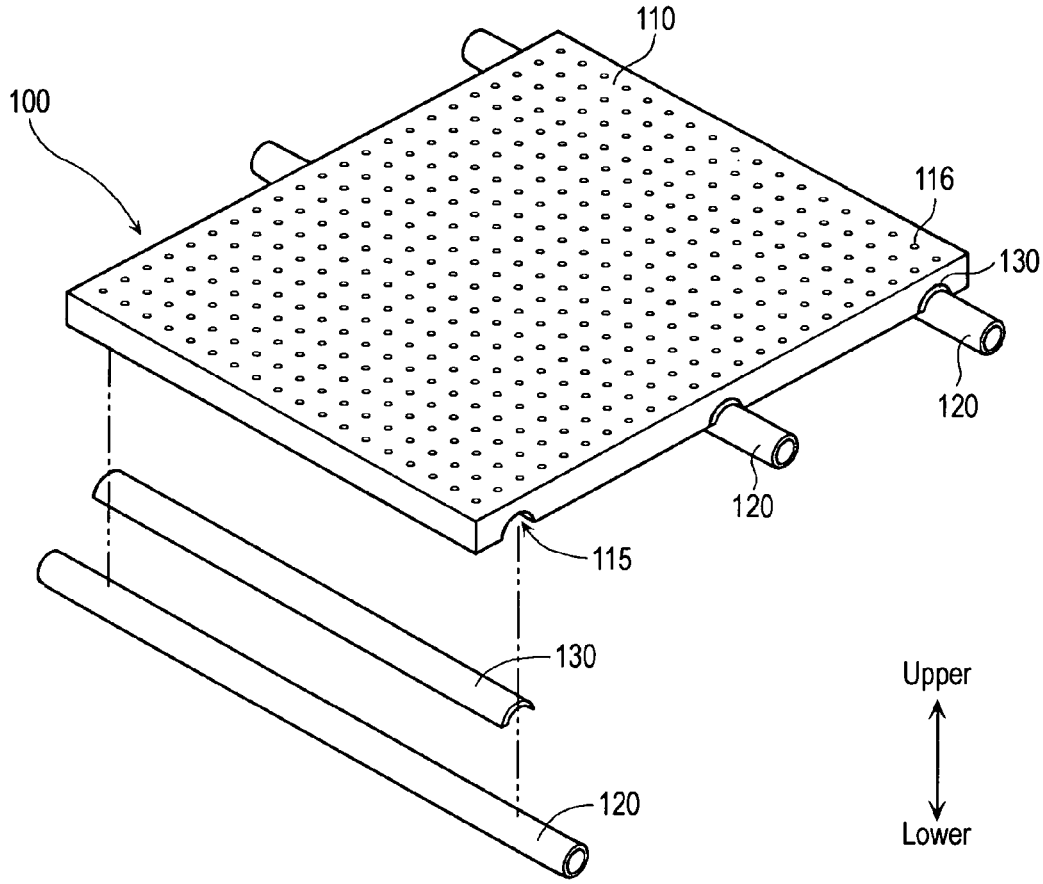
FIG. 2 is an exploded perspective view of the water-cooled grate constructed in accordance with the preferred embodiment of the present invention.

The water-cooled grate constructed in accordance with the preferred embodiment of the present invention will now be described in detail with reference to FIGS. 2 to 4. FIG. 2 is an exploded perspective view of the water-cooled grate constructed in accordance with the preferred embodiment of the present invention.

Figure 3:
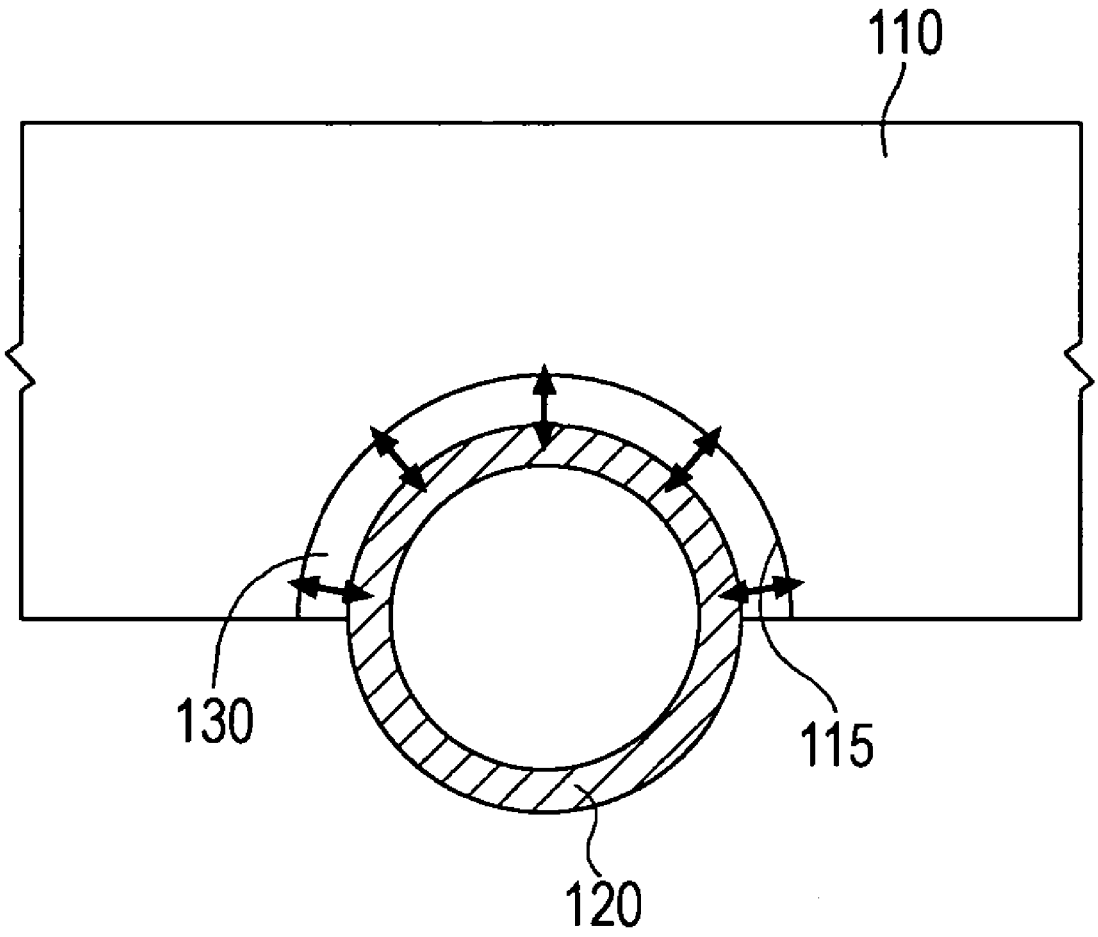
FIG. 3 is a partial side view of the water-cooled grate shown in FIG. 2.
Figure 4:
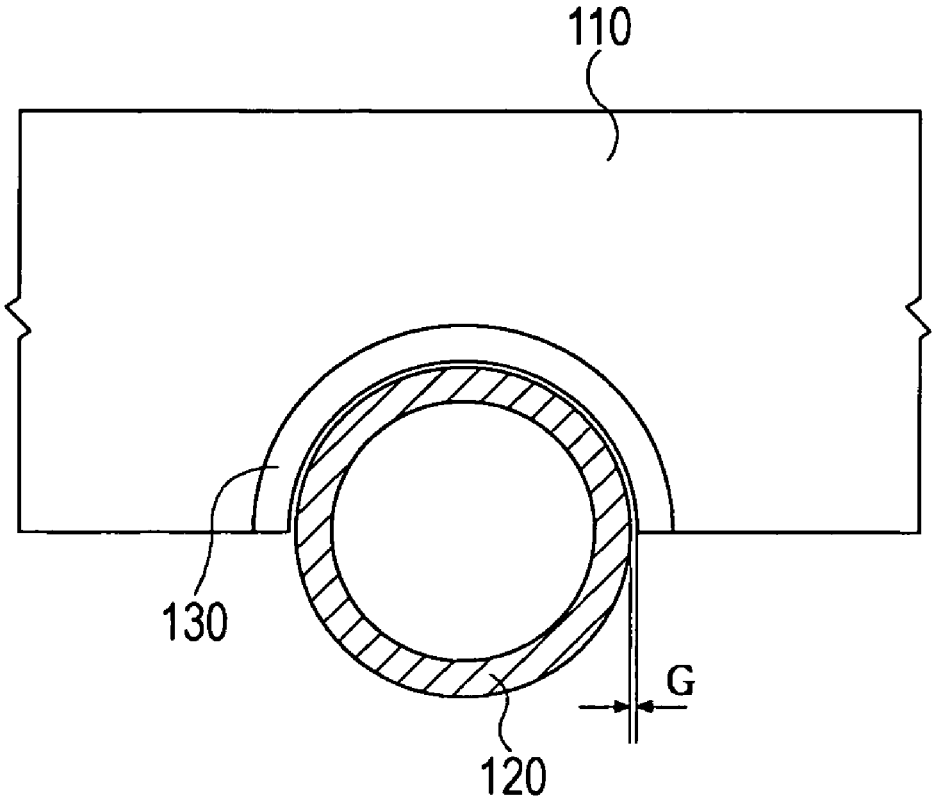
FIG. 4 is a partial side view of the water-cooled grate shown in FIG. 2, which is configured to prevent low temperature corrosion.

FIG. 3 is a partial side view of the water-cooled grate shown in FIG. 2. FIG. 4 is a partial side view of the water-cooled grate shown in FIG. 2, which is configured to prevent low temperature corrosion.

Referring to FIG. 2, the water-cooled grate 100, which is constructed in accordance with the preferred embodiment of the present invention, comprises: a cooling pipe 120 for guiding flow of cooling water; a grate body 110 for placing waste matters to be burned, said grate body 110 being formed with a portion 115 receiving the cooling pipe 120; and a heat transfer controlling member 130 fixed to the pipe-receiving portion 115 for performing thermal deformation of expansion or contraction according to thermal states of the grate body 110.

The waste matters to be burned, e.g., residential or industrial waste matters (not shown), are placed on an upper surface of the grate body 110 and incineration is carried out. In order to facilitate incineration, the grate body 110 has a plurality of combustion gas passages 116 formed therethrough. The grate body 110 is made from metal having high strength and superior corrosion resistance, and may be fabricated by means of casting.

A plurality of pipe-receiving portions 115, which allow the cooling pipe 120 to be arranged in the grate body 110, are provided at a lower surface of the grate body 110. The pipe-receiving portion 115, which is constructed in accordance with the present embodiment, is a groove 115 formed on the lower surface of the grate body 110. The groove 115 has a concave shape, i.e., a semicircular cross-section. The groove 115 is linearly formed in the direction of traversing the grate body 110 on the lower surface of the grate body 110. Further, in case a single cooling pipe is arranged in a serpentine shape on the grate body 110, the groove may be formed on the lower surface of the grate body 110 corresponding to the serpentine shape of the cooling pipe. Also, the groove 115 may be formed on the side surfaces of the grate body 110. In such a case, the cooling pipe 120 may be arranged so as to be formed around the side surfaces of the grate body 110.

Each cooling pipe 120, inside which cooling water for cooling the grate body flows, is arranged in each groove 115. For ease of description, only the pipes arranged in the vicinity of the grate body 110 of an entire piping are shown. The shown cooling pipes 120, if they are connected to each other, may construct a single piping, or may be connected to other pipes for inflow or outflow of cooling water. Also, although not shown in the figures, the cooling pipe 120 may be fixed to the grate body 110 with a portion thereof coupled to the grate body 110 so that their relative positions cannot be changed. Further, the entire piping of the cooling pipes can be coupled to any part of the incinerator. Also, the grate body 110 and the cooling pipe 120 may be positioned so as not to be relatively moved with respect to each other. The number of grooves 115 and the cooling pipes 120 are merely illustrative. Further, the number of grooves 115 and the cooling pipes 120 may vary depending on the size of the incinerator and the design dimensions of the water-cooled grate.

Cooling water flows inside the cooling pipes 120, which are disposed in the groove 115 in the above-described manner, and cools the grate body 110. Cooling water may be circulated in a cooling water circulation system (not shown) which, for example, may comprise a cooling apparatus for cooling water, a bath for collecting water, a cooling water pump, distribution pipes and cooling pipes.

As mentioned above, in order to prevent the corrosion resulting from hot combustion gases in the combustion chamber 2 of the incinerator and to protect the grate body 110, the water-cooled grate 100 constructed in accordance with the present invention performs heat transfer between the grate body 100 and the cooling pipe 120 via the heat transfer controlling member 130 and cools the grate body 110 by means of cooling water flowing inside the cooling pipe 120. Thus, the grate body 110 is not heated at high temperature and can be cooled while avoiding high temperature corrosion.

However, if the amount of waste matters is decreased for the purpose of operating the incinerator at a partial-load or low thermal load of the incinerator just before the shutdown of the incinerator, the temperature of the grate body 110 becomes low. Since cooling water flowing inside the cooling pipe 120 is known to be circulated as heated at about 70° C., there may be an overcooling phenomenon in which the surfaces of the grate body 110 can be cooled up to the temperature of the cooling water flowing inside the cooling pipe 120.

The prescribed temperature, at which moisture contained in the combustion gases in an incinerator condenses on any surface, is known to be in the range of about 130° C. to about 150° C. (hereinafter, such temperature range is referred to as "a due point temperature range"). Thus, when the thermal load of the incinerator becomes low and the grate body 110 becomes a low temperature state, the grate body 100 is overcooled by means of cooling water. Thus, the surface temperature of the grate body 110 can drop below the due point temperature range. In such a case, the combustion gases generated during incineration contain vapor and corrosive gaseous components. As such, those corrosive gaseous components are mixed to vapor and then the vapor condenses on the surfaces of the grate body 110, thereby resulting in low temperature corrosion of the surfaces of the grate body 110. Accordingly, if the water-cooled grate 100 is constructed so as not to be overcooled below the due point temperature range by decreasing the heat transfer between the grate body 110 and the cooling pipe 120 and the cooling of the grate body 110 is less in the state where the thermal load of the incinerator is low and the temperature of the grate body 110 is low, the grate body 110 can be effectively cooled while avoiding low temperature corrosion.

Generally, when heat transfer occurs between two objects, there exists thermal resistance that hinders heat transfer. Particularly, in case the two objects are placed in contact with each other, since their interface is not ideally flat and they have surface roughness that are not to be visually observed, a plurality of air voids having bad thermal conductivity exist between the interfaces. Thus, there exists thermal contact resistance that hinders heat transfer. It is known that such thermal contact resistance becomes small when the contact surfaces are smooth and flat and strongly pressed down toward each other. The present inventor took notice of such phenomenon and envisioned the heat transfer controlling member 130, which performs heat transfer between the grate body 110 and the cooling pipe 120 and which, at the same time, may increase and decrease heat transfer by varying the thermal contact resistance.

Heat transfer between the hot grate body 110 and the cooling pipe 120, inside which cooling water flows in order to cool the grate body 110, occurs via the heat transfer controlling member 130. The heat transfer controlling member 130 may be made from a metal material having a high thermal expansion coefficient or linear expansion coefficient and good thermal conductivity. It can alternatively be fabricated from an alloy material containing such metal material. The heat transfer controlling member 130 is fixed to the grate body 110 and interacts with the cooling pipe 120 by performing thermal deformation of expansion or contraction according to the thermal states of the grate body 110. Therefore, it is preferable that the heat transfer controlling member 130 should have a larger thermal expansion coefficient than that of the grate body 110.

As obviously seen in FIG. 2, the heat transfer controlling member 130 in the present embodiment is an elongated bar-like member with an arcuate cross-section. Since the heat transfer controlling member 130 should guarantee heat transfer between the grate body 110 and the cooling pipe 120, the heat transfer controlling member 130 is configured so as to be coupled to the groove 115 formed on the grate body 110 without clearance and closely contacted to the cooling pipe 120. Accordingly, it should be appreciated that the heat transfer controlling member 130 is configured so as to wrap an overall portion received in the groove 115 of the cooling pipe 120.

The heat transfer controlling member 130 will be described in detail with reference to FIG. 3. The heat transfer controlling member 130, which is provided in the water-cooled grate constructed in accordance with the present invention, is fixed to the grate body 110 with a portion or an entire portion thereof coupled to the grate body (more specifically, to a wall of the groove 115). Accordingly, the heat transfer controlling member 130 undergoes thermal deformation of expansion or contraction through the groove 115 according to the thermal states of the grate body 110. When the grate body 110 is at a high temperature (i.e., high thermal load of the incinerator), the heat transfer controlling member 130 expands at a relatively great extent. Such thermal expansion of the heat transfer controlling member 130 occurs in proportion to the temperature of the grate body 110. As mentioned above, since the grate body 110 and the cooling pipe 120 are equipped so as not to change their relative positions, the expansion of the heat transfer controlling member 130, which is interposed therebetween, presses down the cooling pipe 120 based on the grate body 110. Such pressing down occurs along a full length of the heat transfer controlling member 130 with respect to the overall portion disposed in the groove 115 of the cooling pipe 120. Double-headed arrows shown in FIG. 3 indicate the directions of expansion or contraction of the heat transfer controlling member 130.

Therefore, the heat transfer controlling member 130 and the cooling pipe 120 are pressed down and closely contacted with respect to each other by the expansion of the heat transfer controlling member 130, thereby decreasing the thermal contact resistance therebetween, as described above. At this time, the expansion of the heat transfer controlling member 130 becomes larger in proportion to the temperature-rise of the grate body 110. The thermal contact resistance is also decreased corresponding to temperature-rise of the grate body 110. Then, the heat transfer between the grate body 110 and the cooling pipe 120 is increased corresponding to the extent of temperature-rise of the grate body 110. Consequently, as the temperature of the grate body 110 rises, the heat transfer between the grate body 110 and the cooling pipe 120 is increased corresponding to the extent of temperature-rise.

In the high temperature state of the grate body 110 wherein the thermal load of the incinerator is high, the thermal contact resistance between the heat transfer controlling member 130 and the cooling pipe 120 is decreased due to the expansion of the heat transfer controlling member 130. As such, the heat transfer between the grate body 110 and the cooling pipe 120 is increased in comparison to their direct contact without the heat transfer controlling member 130, thereby improving the cooling performance of the water-cooled grate 100.

On the other hand, in case of low thermal load of the incinerator (i.e., when the temperature of the grate body 110 of the high temperature state becomes low or the incineration occurs during the low temperature state of the grate body 110), the heat transfer controlling member 130 undergoes thermal deformation of contraction or expands at a relatively small extent in comparison to the high temperatures state. In such a case, the extent at which the heat transfer controlling member 130 presses down the cooling pipe 120 becomes small in comparison to the high temperature state and the thermal contact resistance between the heat transfer controlling member 130 and the cooling pipe 120 becomes great. Thus, the heat transfer therebetween is decreased in comparison to the high temperature state wherein the thermal load of the grate body 110 is high.

In the state where the thermal load of the incinerator is low and the grate body 110 remains at low temperature, the heat transfer controlling member 130 expands at a relatively small extent or contracts in comparison to the high temperature state. Since the close contact of the heat transfer controlling member 130 and the cooling pipe 120 is weaker than the high temperature state and the thermal contact resistance between the heat transfer controlling member 130 and the cooling pipe 120 becomes correspondingly larger, the heat transfer between the grate body 110 and the cooling pipe 120 is decreased in comparison to the high temperature state of the grate body 110. Thus, since the heat transfer between the grate body 110 and the cooling pipe 120 is decreased with temperature-drop of the grate body 110, the overcooling of the grate body 110 can be avoided as the temperature of cooling water.

Further, low temperature corrosion, which occurs due to overcooling of the grate body 110, may be prevented by ceasing the contact between the grate body 110 and the cooling pipe 120. FIG. 4 illustrates a configuration of the water-cooled grate 100 at a normal temperature wherein incineration does not take place. Referring to FIG. 4, the cooling pipe 120 is provided with respect to the grate body 110 so that a constant and infinitesimal gap G may be formed between the heat transfer controlling member 130 and the cooling pipe 120 at a normal temperature.

If incineration is initiated with such configured water-cooled grate 100, the temperature of the grate body 100 rises and the heat transfer controlling member 130 undergoes thermal deformation of expansion accordingly. With the temperature-rise of the grate body 110, the heat transfer controlling member 130 expands and thus becomes in contact with the cooling pipe 120 beyond the gap G Then, the heat transfer between the grate body 110 and the cooling pipe 120 begins and the cooling of the grate body 110 occurs. Subsequently, the higher the temperature of the grate body 110 is, the larger the expansion of the heat transfer controlling member 130 will be, as well as the increase in the heat transfer between the grate body 110 and the cooling pipe 120, as described above.

On the contrary, in case the temperature of the grate body 110 drops from the high temperature state, the heat transfer controlling member 130 expands at a relatively small extent or becomes gradually contracted in comparison to the high temperature state. Consequently, the heat transfer controlling member 130 is separated from the cooling pipe 120 at a certain point in time, and the heat transfer between the grate body 110 and the cooling pipe 120 is broken.

In case the point of time at which the heat transfer controlling member 130 is connected to or separated from the cooling pipe 120 is set so as to coincide with the point of time at which the surface temperature of the grate body 110 rises just beyond the due point temperature range, the overcooling of the grate body 110 can be avoided below the due point temperature range. In other words, if the gap G, which is formed between the heat transfer controlling member 130 and the cooling pipe 120, is determined so that when the grate body 110 is heated above the due point temperature range, the heat transfer controlling member 130 expands and can be placed in contact with the cooling pipe 120. Thus, the above-mentioned problem can be avoided.

More specifically, when the grate body 110 is heated from a normal temperature beyond the due point temperature range to higher temperature, the grate body 110 and the cooling pipe 120 are not placed in contact with each other. This is because of the gap G and the heat transfer does not occur, as well as the grate body 110 not being cooled by means of cooling water from the normal temperature to the due point temperature range. Further, when the grate body 110 transitions from the high temperature state to the low temperature state due to the low thermal load of the incinerator, the heat transfer controlling member 130, which performs heat transfer while contacting the cooling pipe 120, is separated from the cooling pipe 120 just above the due point temperature range. Thus, the heat transfer between the grate body 110 and the cooling pipe 120 is broken and the grate body 110 is not overcooled below the due point temperature range. Consequently, the heat transfer controlling member 130 is contacted to or separated from the cooling pipe 120 just above the due point temperature range. As such, the low temperature corrosion of the water-cooled grate can be prevented automatically and mechanically.

In summary, as the grate body 110 proceeds from the low temperature state to the high temperature state, the heat transfer between the grate body 110 and the cooling pipe 120 is increased due to the decrease of thermal contact resistance and the increase of heat transfer, which result from the expansion of the heat transfer controlling member 130. Thus, the cooling performance becomes improved when compared to a case where the grate body 110 and the cooling pipe 120 are contacted directly. Also, as the grate body 110 proceeds from the high temperature state to the low temperature state, the heat transfer between the grate body 110 and the cooling pipe 120 is decreased due to the increase of thermal contact resistance and the decrease of heat transfer, which result from the contraction of the heat transfer controlling member 130 (more specifically, less expansion than the high temperature state of the grate body 110). Thus, the overcooling of the grate body 110 can be avoided.

Moreover, in case of forming the gap G, which equals the extent at which the heat transfer controlling member 130 expands when the grate body 110 remains just above the due point temperature range, between the heat transfer controlling member 130 and the cooling pipe 120, the overcooling of the grate body 110 may be prevented automatically and mechanically by eliminating the heat transfer between the grate body 110 and the cooling pipe 120. Consequently, the heat transfer between the grate body 110 and the cooling pipe 120 does not occur below the due point temperature range because of the gap G formed between the heat transfer controlling member 130 and the cooling pipe 120.

Figure 5:
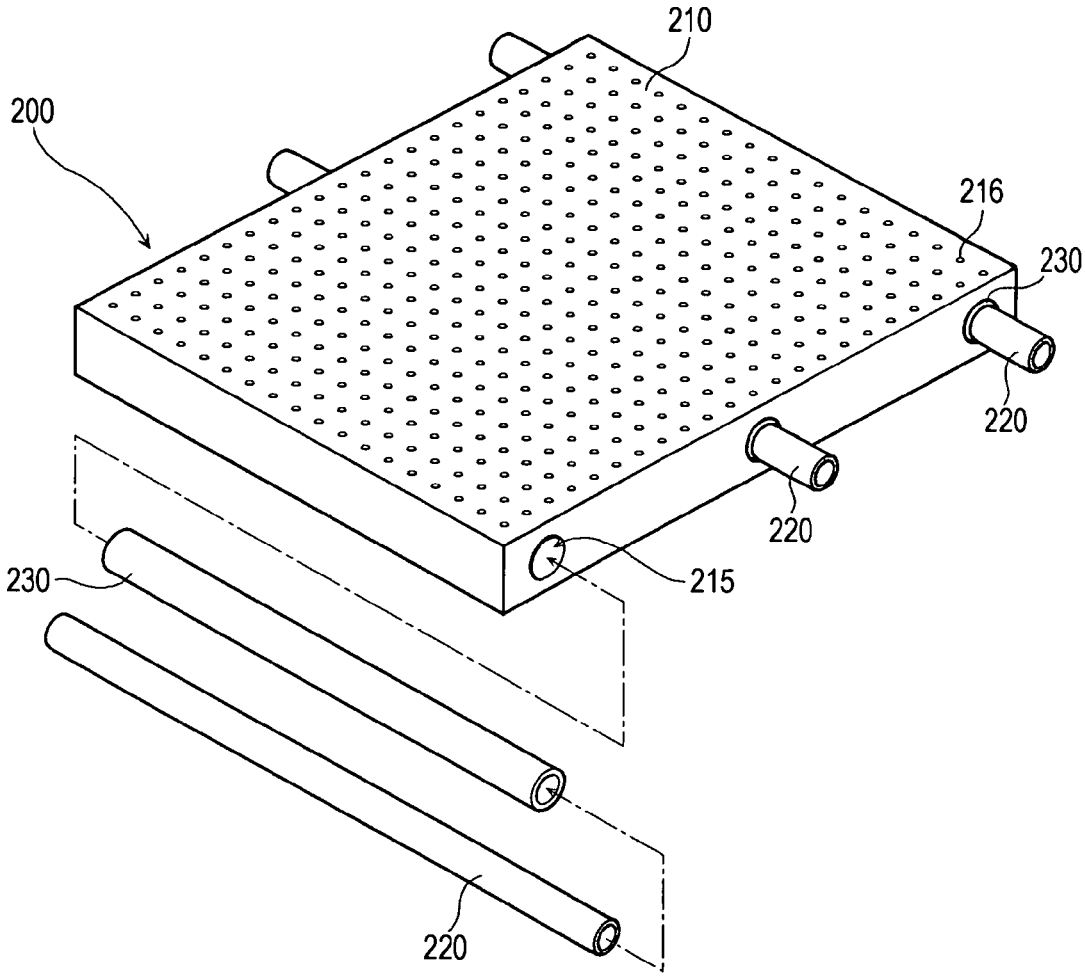
FIG. 5 is an exploded perspective view of the water-cooled grate constructed in accordance with another preferred embodiment of the present invention.
Figure 6:
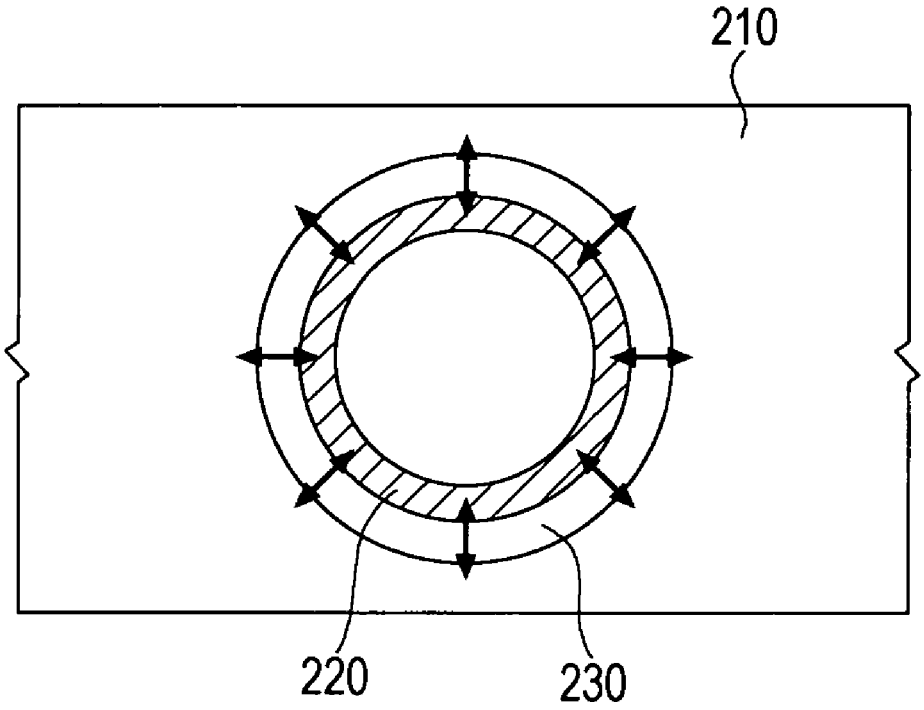
FIG. 6 is a partial side view of the water-cooled grate shown in FIG. 5.
Figure 7:
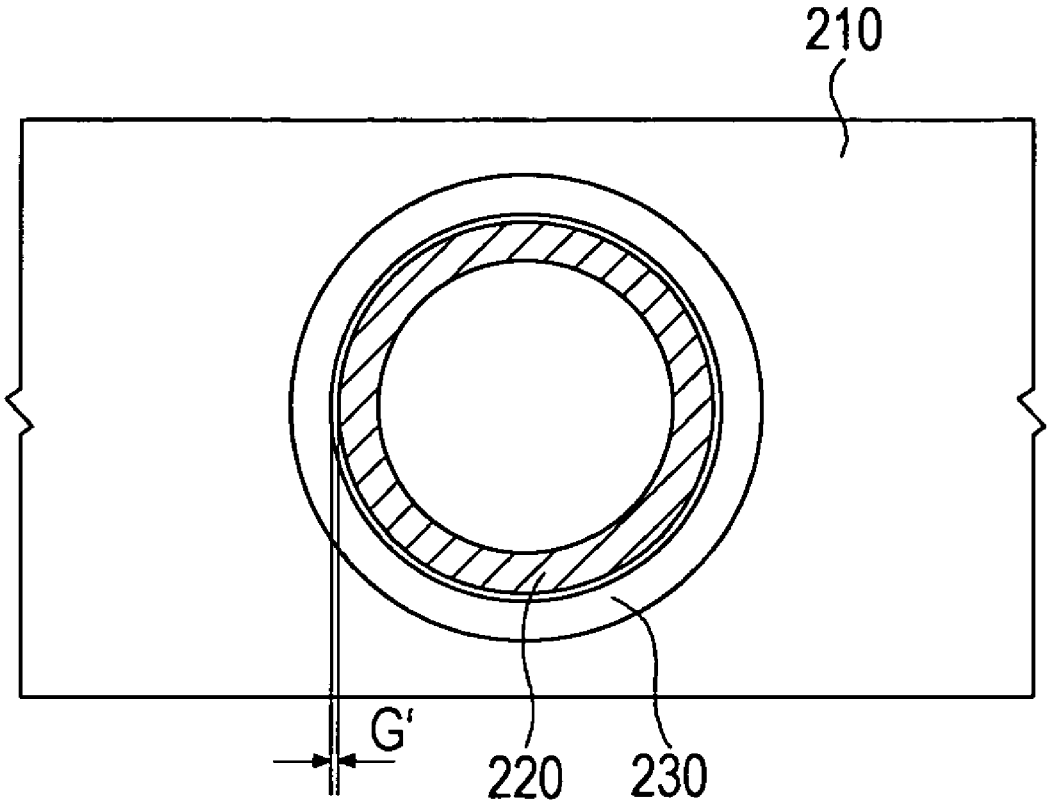
FIG. 7 is a partial side view of the water-cooled grate shown in FIG. 5, which is configured to prevent low temperature corrosion.

FIGS. 5 to 7 illustrate a water-cooled grate 200 constructed in accordance with another preferred embodiment of the present invention. The present embodiment has the same configuration as the water-cooled grate 100, which was described with reference to FIGS. 2 to 4 except that a pipe-receiving portion 215, in which a cooling pipe 220 is disposed, is configured as a bore passing through a grate body 210 and a heat transfer controlling member 230 has an altered configuration corresponding to the pipe-receiving portion 215.

As clearly shown in FIG. 5, the cooling pipe 220 is disposed in the bore 215 passing through the grate body 210. Accordingly, unlike the above embodiment described with reference to FIGS. 2 to 4, the cooling pipe 220 is completely embedded inside the grate body 210.

Since the cooling pipe 220 is disposed through the bore 215, the heat transfer controlling member 230, which is disposed between the grate body 210 and the cooling pipe 220, preferably takes the form of an elongated tube. Accordingly, the heat transfer controlling member 230 completely wraps the cooling pipe 220 and thus, the heat transfer between the grate body 210 and the cooling pipe 220 can be improved in comparison to the above-described water-cooled grate 100.

The heat transfer controlling member 230 is fixed to the grate body 210 (more specifically, a wall of the bore 215 passing through the grate body 210) through a portion or an entire portion thereof and is placed in contact with the cooling pipe 220 disposed inside thereof. The heat transfer controlling member 230 changes the extent of pressing down the cooling pipe 220 by means of thermal deformation of expansion or contraction, thereby varying the thermal contact resistance to the cooling pipe 230. Since the heat transfer controlling member 230 takes the form of a tube, the expansion and contraction of the heat transfer controlling member 230 in the present embodiment occurs in a radial or diametrical direction (e.g., in the direction of double-headed arrows shown in FIG. 6). The mechanism of thermal deformation of expansion or contraction of the heat transfer controlling member 230 is similar to the embodiment described with reference to FIGS. 2 to 4. However, a detailed description thereof is omitted herein.

The water-cooled grate 200 constructed in accordance with the present embodiment is also configured so as to form a gap G' between the heat transfer controlling member 230 and the cooling pipe 220. The cooling pipe 220 is arranged so as to pass through the heat transfer controlling member 230, which is fixed to the bore 215. It is then fixed in the state where the cooling pipe 220 and the heat transfer controlling member 230 are maintained so as not to be in contact with each other, thereby forming the gap G'. As described above, a distance of the gap G' is determined so that the heat transfer controlling member 230 expands and can be contacted to the cooling pipe 230 when the temperature of the grate body 210 remains just above the due point temperature range. Accordingly, the heat transfer does not occur between the grate body 210 and the cooling pipe 220 below the due point temperature range. Thus, the low temperature corrosion, which is caused by overcooling the grate body 210 below the due point temperature range, can be prevented.

While the above-described heat transfer controlling member 130 and 230 are configured so that a single member can be contacted to the cooling pipe 120 and 220 in the groove 115 or the bore 215, the shape of the heat transfer controlling member is not limited to a bar shape with an arcuate cross-section of a single member or a tube shape of a single member. In arranging the heat transfer controlling member between the grate body and the cooling pipe, a plurality of elongated slender bar-like heat transfer controlling members, each of which has a length similar to the length of the groove 115 or the bore 215, may be arranged in the groove 115 or the bore 215.

Figure 8:
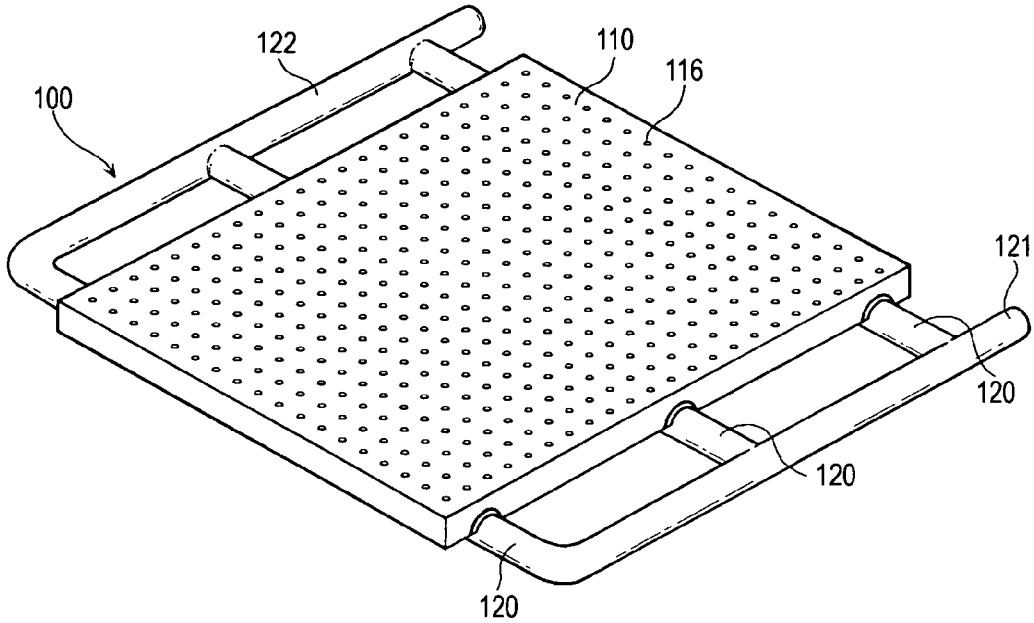
FIG. 8 is a perspective view illustrating a piping structure constructed in accordance with a preferred embodiment of the present invention.

FIG. 8 illustrates a piping structure of the water-cooled grate constructed in accordance with the present invention. A structure, wherein a single piping is provided and cooling water flows in at an inlet of one side and then flows out at an outlet of the other side, may be generally employed for flow of cooling water passing through the grate body 110. However, the cooling water in the water-cooled grate 100, which is constructed in accordance with the present invention, is supplied in a parallel manner that cooling water flows into and out of each cooling pipe 120 arranged in parallel with each other in a plane of the grate body 110.

To this end, as shown in FIG. 8, the water-cooled grate 100 further comprises first and second pipes 121 and 122, which are provided at each side of the grate body 110 and connect the cooling pipes 120, for guiding inflow and outflow of cooling water. That is, each pipe 121 and 122 connects the end portions of the cooling pipes 120 coming out in parallel from one side of the grate body 110, respectively. A first pipe 121 serves as a pipe for inflow of cooling water and a second pipe 122 serves as a pipe for outflow of cooling water. On the contrary, the first pipe 121 may serve as a pipe for outflow of cooling water and the second pipe 122 may serve as a pipe for inflow of cooling water.

According to the above constitution, since cooling water simultaneously flows into and out of the grate body 110 through the plurality of cooling pipes 120 arranged in parallel, the cooling performance of the water-cooled grate 110 can be further improved. It may cause a drop in cooling performance wherein a single cooling pipe runs throughout the entire water-cooled grate. This is because the longer the piping, the lower the temperature of the cooling water will be as it goes toward an outlet. However, as shown in FIG. 8, if cooling water may be supplied through a kind of a manifold type, wherein the cooling pipes 120 passing through the grate body 110 are arranged in parallel to each other and one inflow pipe 121 or 122 diverges into the cooling pipes 120, a length of the piping in which cooling waters flow is shortened while the cooling performance of the grate body 110 can be further improved. It should be noted that constructing the manifold type piping could be applied to the water-cooled grate 200 described with reference to FIGS. 5 to 7.

As described above, the water-cooled grate constructed in accordance with the present invention may provide the following advantages.

First, since the heat transfer controlling member expands with temperature-rise of the grate body and the heat transfer between the grate body and the cooling pipe is increased, the cooling performance of the water-cooled grate is improved.

Second, since the heat transfer controlling member contracts with the temperature-drop of the grate body of the high temperature state and the heat transfer between the grate body and the cooling pipe is decreased, the overcooling of the water-cooled grate can be avoided.

Third, the overcooling of the grate body can be avoided below a due point temperature range. This is because a gap is formed between the heat transfer controlling member and the cooling pipe so that the heat transfer controlling member expands and can be contacted to the cooling pipe when the grate body remains just above the due point temperature range.

Therefore, since a water-cooled grate is provided, which can be cooled while coping with low temperature corrosion as well as high temperature corrosion, the maintenance costs of an incinerator can be reduced and the operation of the incinerator can be stabilized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A water-cooled grate for use in an incinerator, comprising:

at least one cooling pipe for guiding a flow of cooling water;

a grate body for placing waste matters to be burned, the grate body being formed with a pipe-receiving portion for receiving the cooling pipe; and a heat transfer controlling member fixed to the pipe-receiving portion for increasing and decreasing a heat transfer between the grate body and the cooling pipe by varying a thermal resistance to the cooling pipe through a thermal deformation according to a temperature change of the grate body.

2. The water-cooled grate of claim 1 wherein the heat transfer controlling member is configured so as to wrap the cooling pipe received in the pipe-receiving portion.

3. The water-cooled grate of claim 2 wherein the pipe-receiving portion is a groove formed at a surface of the grate body.

4. The water-cooled grate of claim 2 wherein the pipe-receiving portion is a bore passing through the grate body.

5. The water-cooled grate of claim 1 wherein the heat transfer controlling member and the cooling pipe are positioned with respect to each other so that a constant gap is formed therebetween at a normal temperature.

6. The water-cooled grate of claim 5 wherein the gap is formed so that the heat transfer controlling member expands and contacts the cooling pipe when the temperature of the grate body remains above a due point temperature range.

7. The water-cooled grate of claim 1 wherein the heat transfer controlling member is fabricated from a metallic material having a thermal expansion coefficient greater than that of the grate body.

8. The water-cooled grate of claim 1 wherein a plurality of cooling pipes is provided and the water-cooled grate further comprises first and second pipes connecting the cooling pipes, and wherein the first pipe guides an inflow of cooling water and the second pipe guides an outflow of cooling water passing through the cooling pipes.

* * * * *